United States Patent [19]

Poma

[11] 4,018,056

[45] Apr. 19, 1977

[54] APPARATUS FOR FORMING CAST-IN-PLACE CASELESS CONCRETE PILES AND THE LIKE

[75] Inventor: Luis Poma, San Salvador, El Salvador

[73] Assignee: Interpile USA, Inc., New Orleans, La.

[22] Filed: July 18, 1975

[21] Appl. No.: 597,089

[52] U.S. Cl. ..... 61/53.64; 61/56.5; 61/53.7

[51] Int. Cl.[2] ..... E02B 5/66

[58] Field of Search ..... 61/53.64, 53.66, 53.52, 61/56, 56.5, 63, 53.7

[56] References Cited

UNITED STATES PATENTS

| | | | |
|---|---|---|---|
| 2,008,521 | 7/1935 | Takechi | 61/56 X |
| 3,712,066 | 1/1973 | Hartzell | 61/53.64 |
| 3,851,485 | 12/1974 | Steding | 61/53.52 |
| 3,881,320 | 5/1975 | Gendron | 61/53.64 |
| 3,925,998 | 12/1975 | LeCorgne | 61/53.64 |

*Primary Examiner*—Jacob Shapiro
*Attorney, Agent, or Firm*—Mason, Fenwick & Lawrence

[57] ABSTRACT

Apparatus for forming cast-in-place caseless concrete piles wherein an elongated mandrel having a driving tip or foot releasably coupled on its lower end to be driven into the ground and form a pile-forming hole. The mandrel passes through the lower discharge opening of a fill hopper at ground level containing a supply of flowable concrete which flows by gravity into the pile-forming hole as it is being formed. The fill hopper has a self-sealing rigid cylindrical skirt extending downwardly from the discharge opening, and the driving tip or foot has an enlarged circular portion of slightly larger diameter than the skirt and axially alined vertically below the skirt to form the pile hole of such size and shape that the skirt advances into the pile hole during initial soil penetration of the tip to seal against loss of concrete along the ground. The fill hopper is compartmentalized to provide a plurality of substantially like capacity subdivision compartments each adapted to receive a quantity of the flowable fill material, and discharge control means are provided for each of the compartments for permitting discharge of fill material into the pile-forming hole being formed by the mandrel and tip.

3 Claims, 11 Drawing Figures

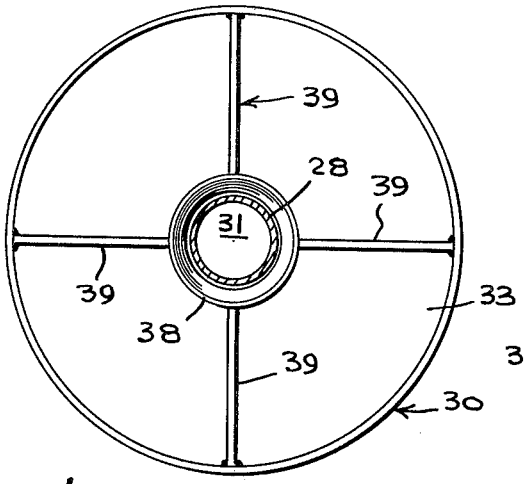
Fig-4
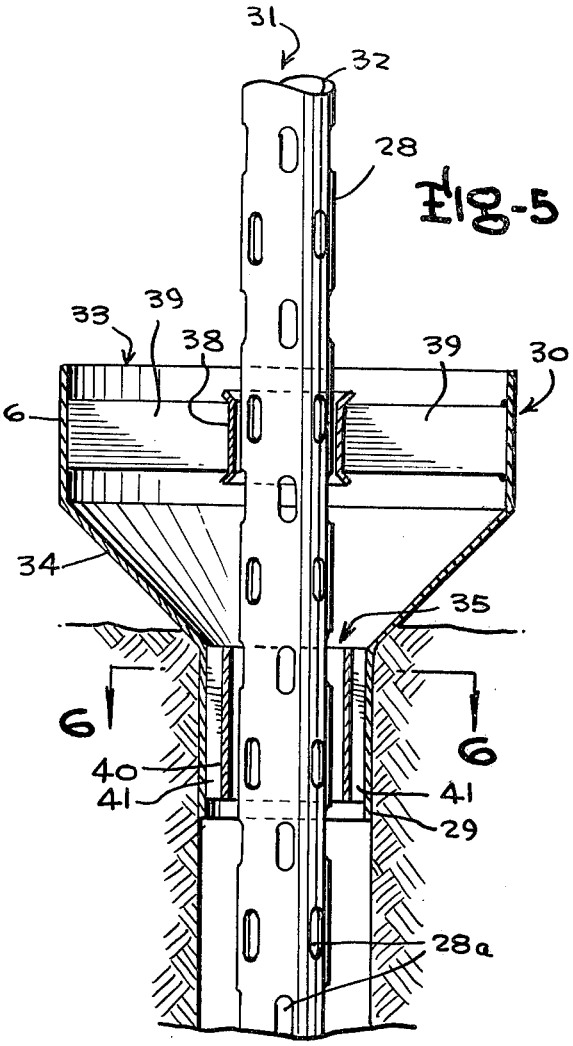
Fig-5
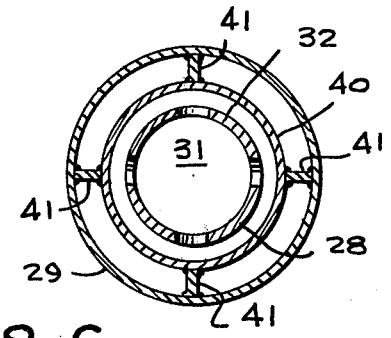
Fig-6
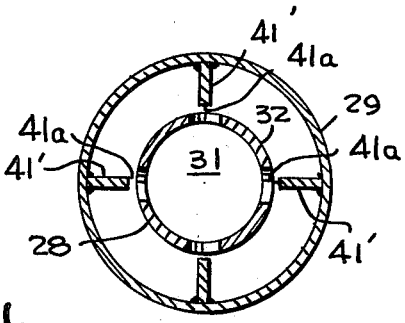
Fig-6-A
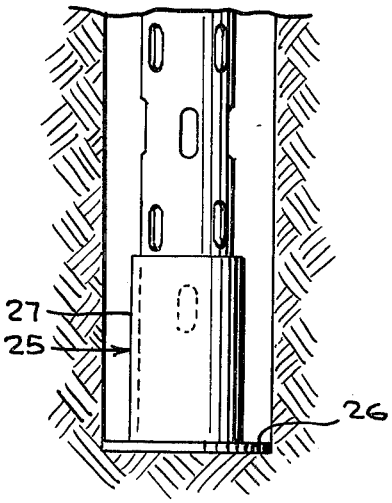

APPARATUS FOR FORMING CAST-IN-PLACE CASELESS CONCRETE PILES AND THE LIKE

BACKGROUND AND OBJECTS OF THE INVENTION

The present invention relates in general to apparatus used in connection with forming cast-in-place caseless concrete piles. More particularly, the present invention relates to the construction of various hopper devices, and the manner of installation and use of the hopper devices, at a pile-forming site, to direct and control the flow of fill material designed to form the caseless concrete pile into the pile-forming cavity being formed in the ground. The hopper devices are used in the course of practice of the method of forming cast-in-place caseless concrete piles by driving into the ground a pile tip or driving foot member releasably assembled onto a hollow tubular driving mandrel to form the pile-forming cavity or hole, and concurrently filling the pile-forming hole with concrete.

One known procedure for forming caseless concrete piles for which the fill hoppers of the present invention are suitable involves advancing into the soil some sort of pile tip, achieved, for example, by the use of a hollow driving mandrel and conventional pile-driving rig, and continuously providing an adequate supply of fluid concrete around and/or within the mandrel so that the concrete can flow or be directed into the ground cavity being formed by the driving tip and mandrel. In practicing this pile-forming procedure, it is desirable to have some type of receptacle or hopper device for containing the concrete prior to its descent into the cavity being formed by the tip and driving mandrel assembly, and for preventing unnecessary spillage. Various embodiments of these devices, frequently called fill hoppers, have been proposed. Some designs for such fill hoppers proposed by others have embodied shapes wherein downwardly converging planes or curvilinear surfaces are formed around the driving mandrel, thereby directing the flow material into the cavity. To the best of applicant's knowledge, it has been customary to merely rest the bottom of these prior art fill hoppers upon the ground at the pile site, and considerable difficulty has been experienced in achieving an effective seal between the bottom of the fill hopper and the soil. The lack of this seal has caused excessive spillage of concrete during driving of the mandrel, and thereby adversely affected the economics of the pile-forming operation. Another problem encountered with these prior art fill hoppers is that their weight and size made them difficult to move about to the many pile-forming sites of a given building excavation or pile-driving job, even when the hoppers are mounted on wheels.

An object of the present invention is the provision of novel apparatus for formation of cast-in-place caseless concrete piles involving forming of pile-forming cavities or holes in the soil, by driving a driving tip or foot member into the soil with a driving mandrel extending vertically downwardly through a lower discharge opening of a fill hopper containing a supply of flowable concrete to be directly supplied to the pile-forming cavity concurrently during its formation, wherein the hopper is provided with a downwardly projecting lower extremity or skirt forming a surround about the lower discharge opening to follow the driving tip or foot into the ground during initial penetration of the soil, and thus provide a seal with the soil at the lower opening of the hopper.

Another object of the present invention is the provision of a novel fill hopper construction for use in forming cast-in-place caseless concrete piles by a driving tip or foot member releasably secured to a driving mandrel extending downwardly through fill hopper, wherein the fill hopper can be readily handled by two men, to be moved about to various pile-forming sites in a given pile-forming job.

Also, in the practice of forming cast-in-place caseless concrete piles by the method hereinabove discussed, it has been found that a problem of drift is encountered from time to time, wherein the center axis of the fill hopper and/or of the driving mandrel moves out of the true vertical or perpendicular position during the course of driving the driving tip into the ground for forming a given pile. This results in pilings which are not vertical and sometimes result in piling being driven in such a way that they intersect each other during the driving. Obviously, the intersection of one pile with another is undesirable from the design standpoint. In addition to this, when piles are formed which utilize a boot-like driving tip, wherein the outside diameter of the mandrel is somewhat smaller than the inside diameter of the sleeve portion of the driving boot, there can be a tendency for the boot to move out of vertical alignment with the mandrel, tending to cause the driving force to be directed at an angle away from the vertical, and thus lead the driving foot and mandrel to an out-of-vertical position. To the best of my knowledge, others have not addressed themselves to these problems.

Another object of the present invention, therefore, is the provision of a fill hopper which has means facilitating precise centering of the driving mandrel with the center axis of the fill hopper and maintenance of the mandrel in a vertically aligned position relative to the vertical axis through the top of the pile-driving site and the vertical center axis of the hopper. This is achieved by providing in the fill hopper, in approximately horizontal alignment with its upper opening, an inner ring smaller than the top opening of the fill hopper and supported by rigid horizontal spider support members. This rigid ring, centered in the precise center of the hopper, has an inner diameter corresponding approximately to the outer diameter of the mandrel, and acts as a guide for the mandrel to keep it in vertical alignment. The sealing skirt surrounding the bottom opening of the hopper may be of proper size to guide the mandrel and/or the boot-type tip, or a plurality of circumferentially spaced radial plates or rails or a lower guide ring supported by spider members, may be provided at the lower extremity of the hopper, providing guide surfaces in a circular path smaller than the diameter of lower hopper discharge openings when the latter are substantially larger than the mandrel to increase concrete flow. These plate edges or lower ring act as a lower bearing or guide for the mandrel, and for the driving tip or foot when it is of boot-like construction, coacting with the upper bearing or guide formed by the upper centering ring, to maintain the hopper axis and mandrel vertical.

Yet another problem encountered in the forming of caseless cast-in-place concrete piles, using the herein discussed method, occurs because of the weight of the concrete, which is present in the hopper during driving. Often this large weight becomes unstable, and moves to one side of the fill hopper, or its center of mass moves away from the geometrical center or vertical center line of the hopper, so that the hopper, because of soft soil conditions, is shifted to an out-of-plumb position. This out-of-plumb condition, in turn, causes the driving mandrel to become canted to one side, or inclined relative to the true vertical axis, and it also goes out of plumb. This has the result of producing piles which are not perpendicular.

Another object of the present invention, therefore, is the provision of a fill hopper, with or without guides for the mandrel and driving tip, which hopper is equipped with three or more hydraulic or mechanical jack mechanisms for leveling the hopper prior to and/or during driving of the mandrel. The jacks may be operated either manually or automatically, and in any event are used to level the hopper and maintain its level plumb condition after driving has commenced.

Another significant problem encountered in the forming of cast-in-place caseless concrete piles using the above-described methods arises in connection with the movement of the fill hopper from the site of one pile to the site of the subsequent pile. This becomes a particularly serious problem when using a hopper which is of a size which is not intended to be completely empty of concrete at the end of the forming of one particular pile. Naturally, the concrete which remains in the fill hopper at the conclusion of forming of one pile makes the hopper so heavy that it cannot be easily moved. Another object of the present invention is the provision of a fill hopper for use in the herein described method of caseless concrete pile formation, wherein the fill hopper is equipped with hooks for attachment thereto of lines or cables from the pile-driving rig, so that the hopper can readily be picked up by the cables of the pile-driving rig and moved to the site of the next pile. By provision of a gate mechanism in the fill hopper which can be closed to prevent flow of concrete from the hopper into the bottom-discharge opening thereof, the hopper gate can be closed to retain the residual concrete in the hopper while it is moved to the new pile site.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIG. 4 is a top-plan view of the fill hopper construction of FIG. 3, with the hollow perforated driving mandrel shown in position in the fill hopper;

FIG. 5 is a vertical section view similar to FIG. 3, showing yet another fill hopper construction;

FIG. 6 is a horizontal section view taken through the lower portion of the hopper of FIG. 5, taken along the line 6—6 of FIG. 5;

FIG. 6A is a horizontal section view of a modified form of lower mandrel guide structure, taken from the same section plane as FIG. 6;

DETAILED DESCRIPTION OF PREFERRED EMBODIMENTS

Figure 1:
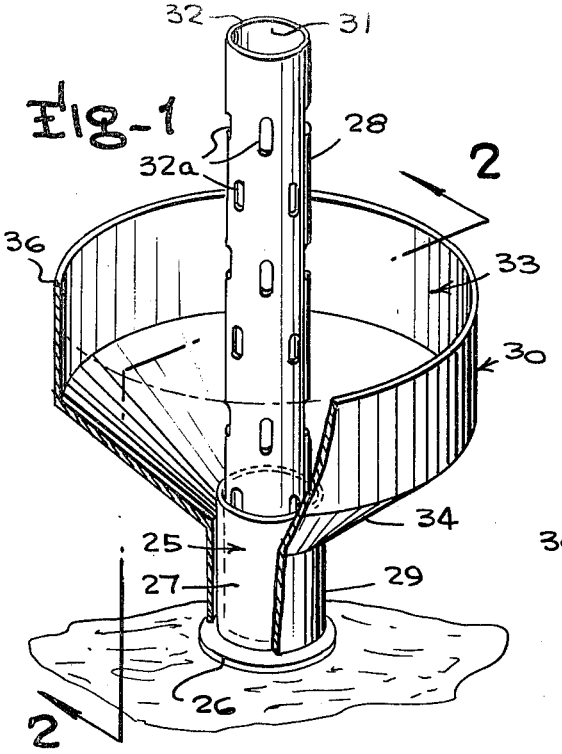
FIG. 1 is a fragmentary perspective view, partially in section, of a caseless concrete pile-forming mandrel and driving boot and an associated fill hopper, constructed in accordance with one embodiment of the present invention.

Referring to the drawings, wherein like reference characters designate corresponding parts throughout the several figures, the present invention concerns various forms of fill hoppers for use in forming caseless cast-in-place concrete piles by driving a hole-forming assembly into the ground to form a pile-forming cavity or hole, and concurrently filling the pile-forming cavity or hole with concrete in flowable condition which then sets in the cavity to form the cast-in-place pile. The fill hoppers of the present invention may be employed, for example, with a pile-cavity-forming rig which comprises a driving tip, foot or boot member, one example of which is indicated at 25 in FIGS. 1 and 2, having a bottom plate or leading end plate 26 of flat circular configuration and an upwardly extending hollow cylindrical sleeve or pipe portion 27 forming an upwardly opening cylindrical socket **27*a* to releasably receive in telescoping relation therein the lower end portion of the driving mandrel 28. The bottom or leading end plate 26 in this embodiment is of somewhat larger diameter than the outer diameter of the upper sleeve portion 27. In the embodiment illustrated in FIGS. 1 and 2, the outer diameter of the bottom plate 26 may exceed the outer diameter of the sleeve portion 27 by approximately 2 inches, as one example, so that the diameter of the bottom plate 26 just exceeds the outer diameter of a bottom cylindrical sealing skirt portion 29 of the fill hopper 30, to be later described. It will be appreciated that the bottom surface of the driving tip or boot member 25** need not be a flat planiform surface, as illustrated, but can be a downwardly converging pointed cone, or can assume other desired configurations, and while the driving tip contemplated in this example would normally be formed of a flat circular metal bottom plate to which an annular or tubular circular pipe section is welded or similarly secured, the driving tip may be formed in other ways and of other materials, as will be apparent to those skilled in the art.

The inner diameter of the upwardly opening hollow cavity or socket **27*a* in the sleeve portion 27 of the driving boot 25 is sized to closely approximate the outer diameter of the lower end portion of the driving mandrel 28, in the described embodiment, to releasably telescopically receive the lower end portion of the driving mandrel therein. The driving mandrel 28 serves as an elongated pusher member to drive the boot member 25 into the ground, and is in the form of an axially elongated hollow cylindrical pipe section having an axial hollow bore or center opening 31 surrounded by a cylindrical outer wall 32 which may be about one inch thick for a driving mandrel of 8 or 10 inches outer diameter, and in the illustrated embodiment is provided with a plurality of openings or apertures 32***a*. These openings 32*a* may be circular or oval slot-like openings disposed at many spaced locations in the cylindrical pipe wall 32 to facilitate passage of fill material such as flowable concrete between the space within the mandrel bore 31 and the space externally surrounding the outer mandrel wall 32.

It will be appreciated that the cross-sectional configuration of the mandrel need not be of annular circular cross-section as shown, but may be of a rectangular tubular configuration with right angular or rounded corners, or may be of other desired cross-sectional configurations providing appropriate rigidity. The cross-sectional configuration of the drive mandrel 28 is chosen, however, so that the total cross-sectional area of the material forming the mandrel wall 32 or the body of the mandrel is much less than the cross-sectional area of the pile-forming hole or cavity being formed in the earth during driving of the driving boot, so that fill material to form the pile, such as flowable concrete, can readily flow by gravity from the fill hopper at the top of the pile-forming hole into the area between the walls or walls of the driving mandrel and the surface of the ground cavity being formed, and if the mandrel is of tubular configuration, can freely flow between the inner bore and outer zone through the openings 32*a*. The lower end of the driving mandrel 28 is suitably shaped to releasably interfit into the upwardly opening socket 27*a* defined by the driving boot sleeve 27, and the upper end of the driving mandrel 28 is suitably shaped to provide for releasably connection of the driving mandrel to the driving head components of a conventional pile-driving rig to permit application of impact driving forces from the pile-driving rig to the upper end of the driving mandrel during forming of the pile-forming cavity in the soil, and to permit withdrawal of the driving mandrel when desired from the completed pile-forming cavity.

In order to effect gravity feeding of the concrete or similar fill material into the pile-forming cavity in the soil during the driving of the driving boot, in the practice of this pile-forming method, the fill hopper 30 is provided at grade level where the pile is to be formed, and has customarily been of the configuration illustrated in the U.S. patents of Jerry A. Steding, No. 3,851,484 and No. 3,851,485, both granted Dec. 3, 1974. Such fill hoppers have inclined sidewalls over at least the lower half of the fill hopper, forming downwardly and inwardly convergent sloping walls extending to a bottom opening in the hopper of a somewhat greater diameter than the diameter of the mandrel, controlled in some cases by some kind of closeable gate, so that the fill material such as flowable concrete is gravity-fed downwardly through the bottom opening into the pile cavity being formed in the earth during driving of the driving foot. The fill hoppers of this prior design have been merely placed upon the ground at the pile-driving site, and because the rim of the bottom opening did not tightly and precisely conform to the ground contours, they have failed to provide proper seals at the bottom of the fill hopper thus allowing excessive spillage of concrete during the driving of the hole for the caseless pile.

Figure 2:
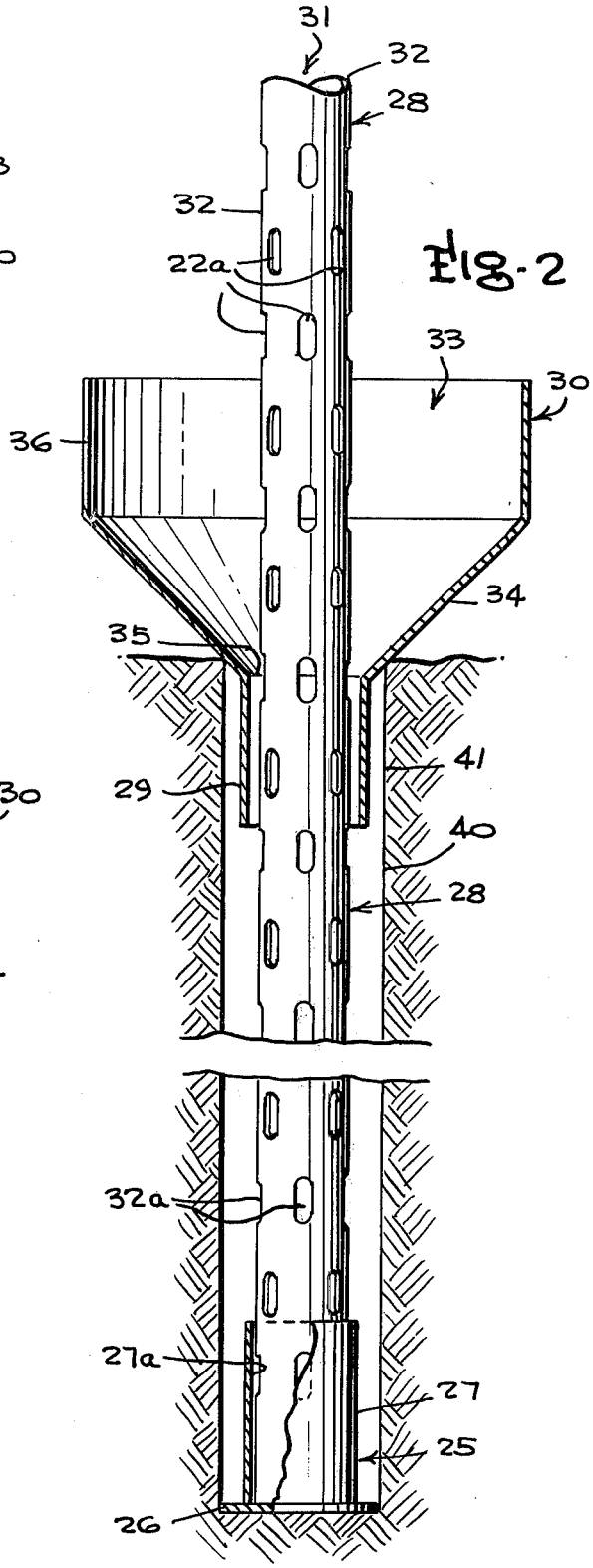
FIG. 2 is a vertical section view, taken from the section plane 2—2 of FIG. 1, showing the fill hopper disposed in self-sealing relationship in the ground with the mandrel and driving boot partially driven into the ground in the course of forming the pile cavity.

The fill hopper of the present invention, in the embodiment illustrated in FIGS. 1 and 2, is indicated by the reference character 30, and comprises an upwardly opening receptacle portion 33 having inwardly and downwardy inclined lower wall portions 34 extending in a truncated conical or frustoconical path to a circular bottom opening 35 for the receptacle portion 33 which is somewhat larger than the outer diameter of the mandrel 28 to allow adequate concrete flow collectively through the mandrel openings 32*a* and mandrel center bore 31 and downwardly through the annular spaces defined by the mandrel and opening 35. Above the conical wall portion 34 of the fill hopper, the sidewalls in the illustrated embodiment define an annular cylindrical band 36 forming a rather large cylindrical space at the upper portion of the receptacle. Thus, in this embodiment, the hopper has a shape similar to that of a funnel wherein the bottom opening 35 of the upwardly opening receptacle portion 33 fits more closely around the mandrel than the top opening of the receptacle portion defined by the upper edge of the annular cylindrical band or wall portion 36.

A hollow cylindrical sealing skirt portion 29 joins the receptacle portion at the bottom of the inclined wall portion 34 and extends axially downwardly concentric with the vertical center axis of the hopper for a distance which, in the illustrated embodiment, corresponds to approximately the axial length of the sleeve portion 27 of the driving boot. The outer diameter of the downwardly extending cylindrical sealing skirt portion 29 conforms to or is just slightly less than the diameter of the bottom plate 26 of the boot member 25 so that the lower edge of the skirt portion 29 of the fill hopper may rest on the annular peripheral portion of the bottom plate 26 projecting outwardly beyond the sleeve portion 27 when the driving boot 25 is placed on the ground at the pile-forming site, with the sleeve portion 27 of the boot member extending concentrically upwardly within the skirt portion 29. In the illustrated embodiments, the sleeve portion 27 extends concentrically about the mandrel slightly into the receptacle area of the fill hopper. Then, when the boot 25 advances into the soil during the initial stages of penetration, when the boot is driven by the mandrel and driving rig, the plate portion 26 of the boot forms a hole in the soil larger than the outer diameter of the sealing skirt portion 29, and the sealing skirt portion 29, under the weight of the hopper, advances into the soil into the pile-forming hole being thus produced by the boot member until the upwardly diverging wall portions 34 of the hopper are stopped from further downward movement by engaging the surface of the soil. The downwardly projecting cylindrical sealing skirt portion 29 extending into the pile-forming hole thereby forms a very good seal with the soil, preventing passage of the fill material from the region of the bottom receptacle opening 35 radially outwardy onto the soil surface surrounding the pile-forming hole. This fill hopper construction can be made in smaller sizes than the customary size of fill hopper used in practicing this method of cast-in-place pile formation, so that by its smaller size it can be easily handled by no more than two men to move the hopper from driving site to driving site, as desired.

Figure 3:
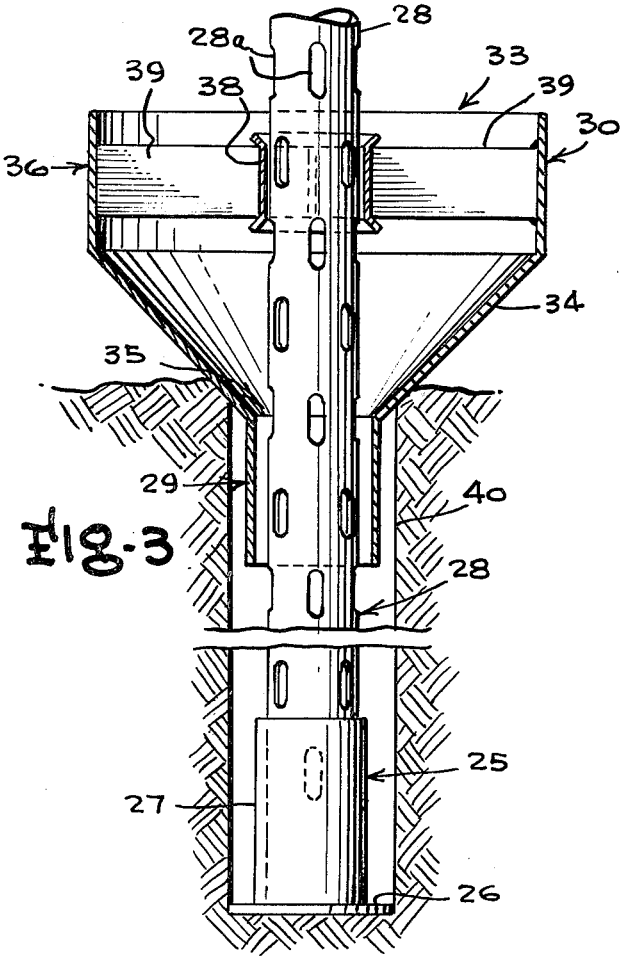
FIG. 3 is a vertical section view, similar to FIG. 2, but showing a modified fill hopper construction having a mandrel-centering ring in the upper portion of the hopper.

FIGS. 3 and 4 illustrate a modified version of the fill hopper construction shown in FIGS. 1 and 2, with additional provision for achieving proper coaxial alignment of the hopper with the driving mandrel and maintaining this relative coaxial alignment notwithstanding forces tending to cause the axis of the hopper to drift relative to the mandrel axis, such as shifting of the concrete fill material in the hopper. The components of the fill hopper, and the driving tip and driving mandrel, of the embodiment illustrated in FIGS. 3 and 4, which correspond to like components of the embodiment illustrated in FIGS. 1 and 2, are indicated by the same reference characters as were employed in the description of the previous embodiment. In the embodiment of FIGS. 3 and 4, however, there is provided in the upper region of the receptacle portion 33 of the fill hoper a mandrel-centering ring 38 in the form of an annular ring having an inside diameter substantially the same as the outer diameter of the mandrel 28, providing a sliding fit for the mandrel extending therethrough. The centering ring 38 is supported in coaxial relation with the vertical center axis through the hopper 30 and the extended center axis of the cylindrical sealing skirt portion 29 by rigid radially extending spider members 39. For example, four of such spider members 39 may be provided, formed of metal plate material, such, for example, as three-quarter-inch or one-inch thick metal plate webs which are welded at their inner ends to the outer surface of the mandrel-centering ring 38, and are welded at their outer ends to the upper cylindrical wall portion 36 of the hopper. In the illustrated example, the mandrel-centering ring 38 may be formed of an 8-inch long section of pipe of an inner diameter approximating the mandrel outer diameter, and having a wall thickness of about one inch, with the opposite ends flared outwardly, supported by four metal plate members forming the spiders 39, arranged in a pair of diametric vertical planes located perpendicular to each other, with the vertical width or height of the plate members being about six inches. By this construction, the fill hopper is maintained in proper coaxial alignment with the mandrel 28, as a result of the sliding fit of the centering ring 38 about the mandrel adjacent the upper end of the fill hopper and the sliding fit (which may be somewhat looser) of the lower cylindrical sealing skirt portion 29 about the mandrel at the lower end of the fill hopper.

Yet another variation is illustrated in FIGS. 5 and 6, wherein components similar to those illustrated in the earlier-described embodiments are identified by the same reference characters. In the form shown in FIGS. 5 and 6, the bottom opening 35 of the receptacle portion 33 of the hopper and the downwardly extending cylindrical sealing skirt portion 29 are of somewhat larger inner diameter than the outer diameter of the sleeve portion 29 of the driving boot and of the driving mandrel, providing an annular opening of about two to four inches difference between its inner radius and outer radius to facilitate more rapid flow of concrete or other fill material downwardly into the pile-forming cavity being formed in the soil because of the greater size of the space outwardly surrounding the mandrel at the discharge opening 35 for flow of concrete therethrough. In this embodiment of FIGS. 5 and 6, the upper mandrel-centering ring 38 and its associated spider members 39 are of the same construction and configuration as that described in the embodiments of FIGS. 3 and 4. However, the cylindrical sealing skirt portion 29 of the fill hopper 30 is of larger inner and outer diameter than the preceding embodiment, so as to have an inner diameter which is several inches greater than the diameter of the mandrel and the diameter of the sleeve portion of the driving boot. In this case, a lower mandrel-centering structure is provided internally in the cylindrical sealing skirt portion 29, which in the illustrated embodiment is in the form of a lower mandrel-centering ring 40 having an inner diameter substantially corresponding to the outer diameter of the sleeve portion 27 of the driving boot and supported in coaxial centered relation within the skirt portion 29 by a plurality of radial spider members such as plates or webs, indicated at 41. Alternatively, the ring portion 40 of the lower mandrel-centering structure may be eliminated, and the four or more radially inwardly projecting spider members or plates 41′ may terminate inwardly in straight inwardly facing flat bearing edges 41*a*, as shown in FIG. 6A, providing the plurality of bearing surfaces confronting the outer surfaces of the boot sleeve portion 27 and mandrel 28 located in a concentric cylindrical path having a diameter corresponding to the inner diameter of the centering ring 40 in the embodiment of FIG. 6.

While the foregoing description of the embodiments illustrated in FIGS. 1 to 7 have described preferred examples in which the inner diameter of the sealing skirt portion 29 in the FIGS. 1 to 4 embodiments, or the inner diameter of the lower centering ring 40 or the cylindrical path of the bearing edges 41*a* in the FIGS. 6 and 6A embodiments corresponded substantially to the outer diameter of the sleeve portion 27 of the boot, it will be appreciated that the inner diameter of the skirt portion 29 or of the lower centering ring 40 or bearing edges 41*a* should have a diameter chosen to bear a selected relation to the outer diameter of the mandrel 28 rather than of the sleeve 27, if the driving tip or foot member 25 is of a type having portions which project inwardly into the hollow bore of the mandrel 28 to center the driving tip rather than having an outwardy surrounding sleeve portion 27. For example, if driving tips or foot members of the configurations illustrated in related co-pending U.S. application Ser. No. 597,090, filed July 18, 1975, by the same Applicant as the present application, are to be driven into the soil by the driving mandrel, such as the mandrel 28, to form the pile-forming cavity, the inner diameter of the upper mandrel-centering ring 38, and the inner diameter of the cylindrical sealing portion 29 for the FIG. 1 and FIG. 3 embodiments (if the rate of concrete flow through the mandrel wall holes 28*a* and downwardly through the mandrel bore is adequate alone to concurrently fill the cavity being formed), or of the lower centering ring 38 of the FIG. 6 embodiment, or of the bearing edges 41*a* of the FIG. 6A embodiment, may be substantially the same diameter and correspond closely to the outer diameter of the mandrel 28 to form a sliding fit with the mandrel to maintain the mandrel and axis of the fill hopper in accurate vertical alignment.

Any of the previously described fill hoppers may be provided with suitable gate-forming structure, located within the receptacle portion 33 of the fill hopper upwardly adjacent the bottom discharge opening 35 for regulating the rate of flow of fill material into the discharge opening, or shutting off such flow when desired.

Figure 7:
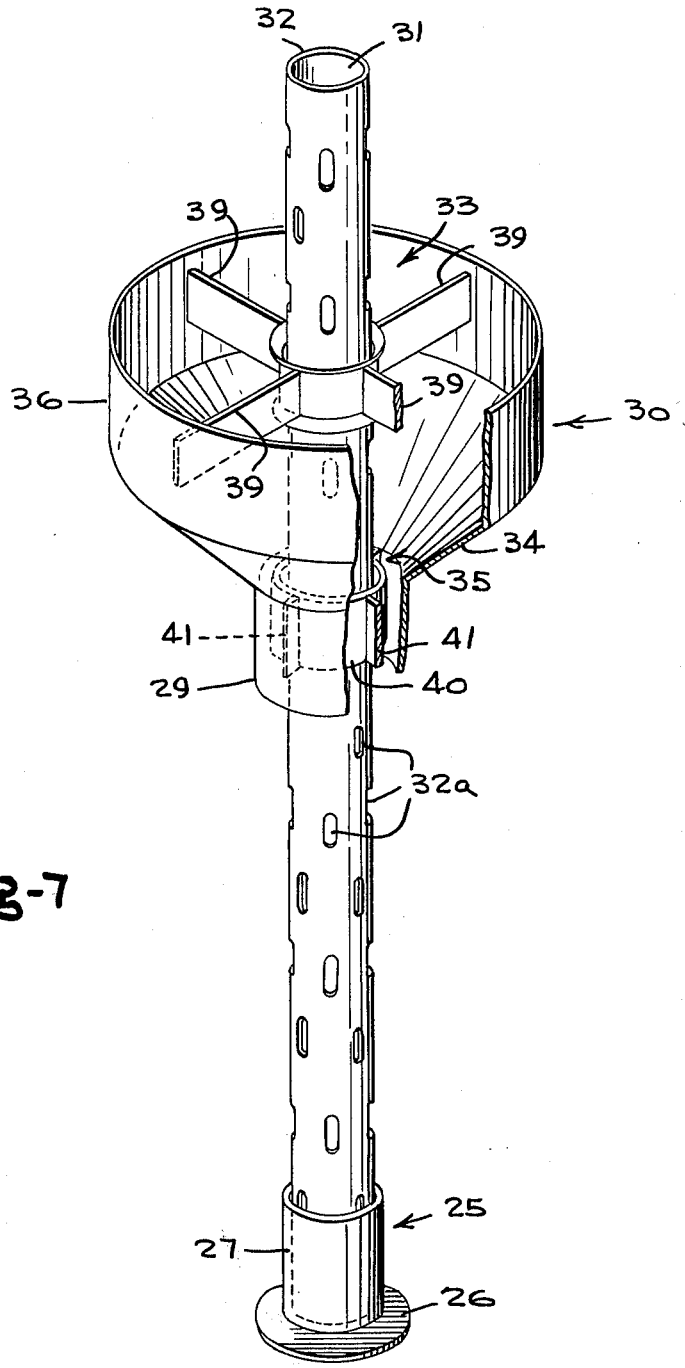
FIG. 7 is a fragmentary perspective view, partially in section, of the fill hopper construction of FIGS. 5 and 6.

For example, this gate-forming structure may take the form of a fixed, cylindrical sleeve or pipe section forming a cylindrical weir or dam extending upwardly from the location of the opening 35 substantially aligned with the sealing skirt portion 29, having openings therethrough adjacent the bottom of the gate-forming pipe, together with a cooperating telescoping cylindrical pipe section movable on the stationary apertured pipe section to close off the openings through the apertured pipe section, or partially overlap such openings to provide the desired flow rate. An example of such gate structure is illustrated in FIGS. 6 and 7 of the previously identified earlier U.S. Pat. No. 3,851,485 of Jerry A. Steding.

Figure 9:
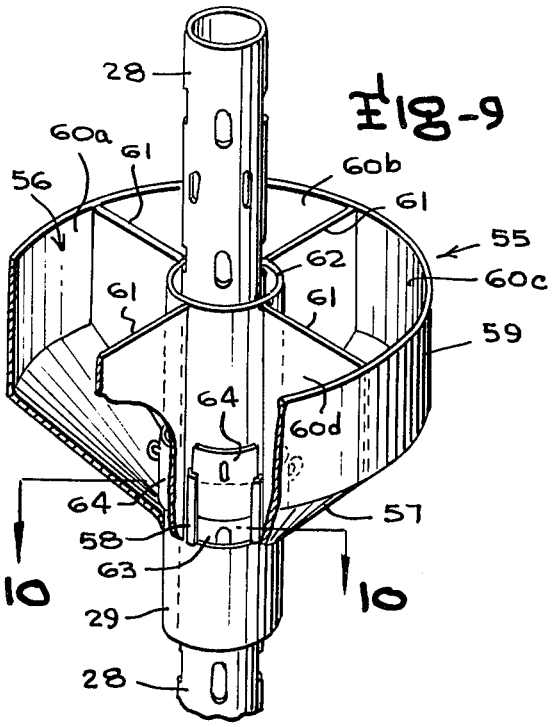
FIG. 9 is a fragmentary persepective view, partially in section, showing the portions of the pile forming mandrel and a modified fill hopper constructed to facilitate measurement of the quantity of concrete being placed into the pile forming hole.
Figure 10:
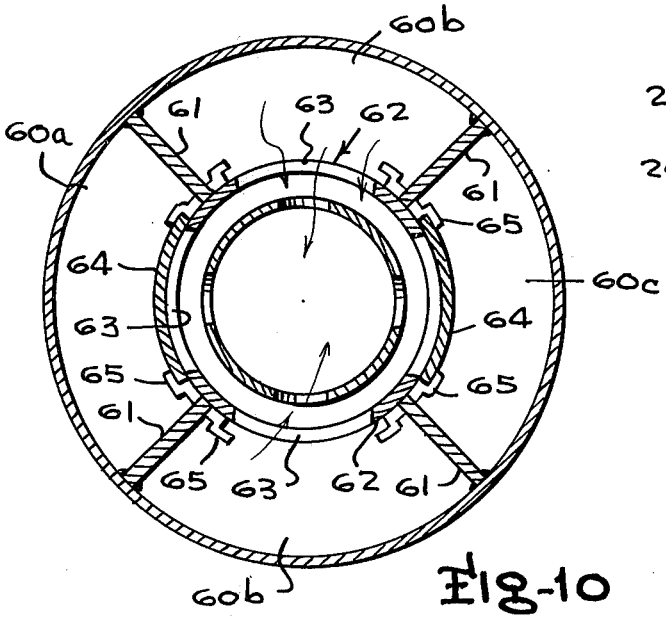
FIG. 10 is a fragmentary horizontal section view of the fill hopper of FIG. 8 illustrating details of the discharge gates for the compartments, taken along the line 10—10 of FIG. 8.

During the forming of piles by the hereinabove described method, it is very desirable to be able to know the quantity of concrete placed into the pile cavity. This can be accomplished in a variety of ways, most commonly by pumping the concrete from the batch plant concrete truck to the site of the pile and metering the quantity of concrete placed in the pile by counting the revolutions of the pump employed. However, the pump is an additional piece of mechanical equipment which must be made available at the site of the pile formation if this method of monitoring the quantity of concrete during pumping is used, and it is desirable to eliminate the necessity of employing a pump if possible. The fill hopper construction illustrated in FIGS. 9 and 10 is designed to accomplish this purpose, as it provides a fill hopper which will not only sink into the upper portion of the pile cavity as the driving tip initially advances into the soil, but also provides a measure of the quantity of concrete being placed into the hole. Referring to FIGS. 9 and 10, the fill hopper is indicated generally by the reference character 55 and may be constructed generally in the manner of any of the previously described embodiments, to provide an upwardly opening receptacle portion 56 having inwardly and downwardly inclined lower wall portions 57 extending in a truncated conical or frusto-conical path to a circular bottom opening 58 for the receptacle portion 56 which is somewhat larger than the outer diameter of the mandrel 28. Above the conical wall portion 57 of the fill hopper, the sidewalls define an annular cylindrical band 59 forming the large cylindrical space at the upper portion of the receptacle which collectively with the conical space circumscribed by the inclined lower wall portion 57 defines the upwardly opening receptacle in which the concrete is collected. The hopper may otherwise be of the type illustrated in FIGS. 1, 3, or 5 previously described herein, or of other configurations or construction.

To provide for measurement of the quantity of concrete being placed in the pile cavity, the fill hopper 55 is partitioned into a number of compartments, shown in the illustrated example as four compartments 60*a*, 60*b*, 60*c* and 60*d* by four radially extending vertical partition walls 61 welded along their outer edges to the inclined lower wall portion 57 and the wall portions forming the band 59 and welded along their radially inner edge to a stationary inner pipe section 62 which is joined at its lower edge to the bottom surface of the fill hopper, for example, at the juncture of the inclined wall portion 57 and the sealing skirt portion 29 extending therebelow. The inner pipe section 62 in the illustrated embodiment is provided with a plurality of apertures 63 providing openings to allow the fill material to flow from each of the respective compartments 60*a* –60*d* therethrough and through the openings in the mandrel into the cavity being created by the driving of the driving tip into the soil. A plurality of vertically slidable gates 64, for example, arcuate plate-like gates, one for each compartment, are supported for sliding movement in outwardly covering relation to the outer surface of the portion of inner pipe section 62 facing the associated compartment so that by raising the respective gates 64, the concrete in the associated compartment can be allowed passage into the pile cavity being formed. In the illustrated example, the lateral edge portions of the gates 64 are slidably supported in guideways formed by guide member 65 to support the gates for vertical sliding movement, and the gates are provided with eyes or hooks near their upper edges for ease of coupling them to lifting cables or similar material handling lines associated with the drilling rig.

It will be appreciated that the various compartments provided in the fill hopper can vary in number, for example, ranging in number from two to any higher number, which will be filled with concrete, usually in rotation, and emptied in some preselected order into the pile cavity as the cavity is being formed. For example, if four compartments 60*a* –60*d* are used as in the illustrated example, the operator after filling the four compartments may, during the driving of the pile cavity, lift the gates 64 for the two diametrically opposite compartments 60*a* and 60*c*, and when they are emptied, then close the gates to those compartments and open the gates to the other diametrically opposite pair of compartments 60*b* and 60*d* to empty them while the emptied compartments 60*a* and 60*c* are being refilled with concrete. By counting the number of compartments which have been emptied during the formation of a particular pile, the operator can then calculate the amount of concrete which had been placed in that pile.

It will be appreciated that various other types of gate structures or trapdoor mechanisms may be employed for controlling discharge of concrete from the compartments and closing of the discharge means, and that these mechanisms can either be manually operated, mechanically operated, or electrically or hydraulically operated, or any combination of these, by conventional means.

When installing cast-in-place caseless concrete piles by any of the methods described above, wherein a cylindrical perforated mandrel is used with a driving tip or boot which is larger in diameter than the diameter of the mandrel, it is desired that the concrete flowing from the fill hopper or concrete supply source downwardly into the pile cavity flows downwardly along the outside of the mandrel as well as flowing into the interior of the mandrel. In other words, as the driving tip advances into the soil, cutting a cavity larger in diameter than the diameter of the mandrel, it is desired that the concrete will flow along the outside of the mandrel as a fluid or semi-liquid encasing shell of concrete as well as flowing through the inner bore of the mandrel. Providing for flow of the concrete along the outside of the mandrel between the exterior mandrel surface and the confronting surface of the pile cavity provides several significant advantages. It has been observed that maintaining a relatively thin envelope of concrete or fill material on the outside of the mandrel encasing the mandrel serves as a lubricant tending to reduce frictional forces between the mandrel wall and the pile cavity wall resisting downward movement of the mandrel into the ground. This lubricating action not only reduces somewhat the resistance to driving of the mandrel and tip as the tip approaches the maximum designed pile depth, but also is especially helpful in reducing forces resisting extraction of the mandrel when the mandrel is being withdrawn after driving to the full depth. Furthermore, experience has indicated that in many cases the provision of the thin outer envelope or mantel of concrete on the outside of the mandrel increases reliably attaining a larger diameter pile than the inside diameter of the mandrel with which the pile was formed. Unless special steps are taken to insure the presence of the outer envelope of concrete, it appears that in some soil conditions, the soil rebounds against the outer surface of the mandrel in the region just above the boot as the pile tip advances deeper into the soil, even though the tip is cutting a cavity larger than the diameter of the mandrel, thus causing the soil to press against the surface of the mandrel and prevent concrete on the outside of the mandrel from flowing downwardly along the outer mandrel surface.

Figure 8:
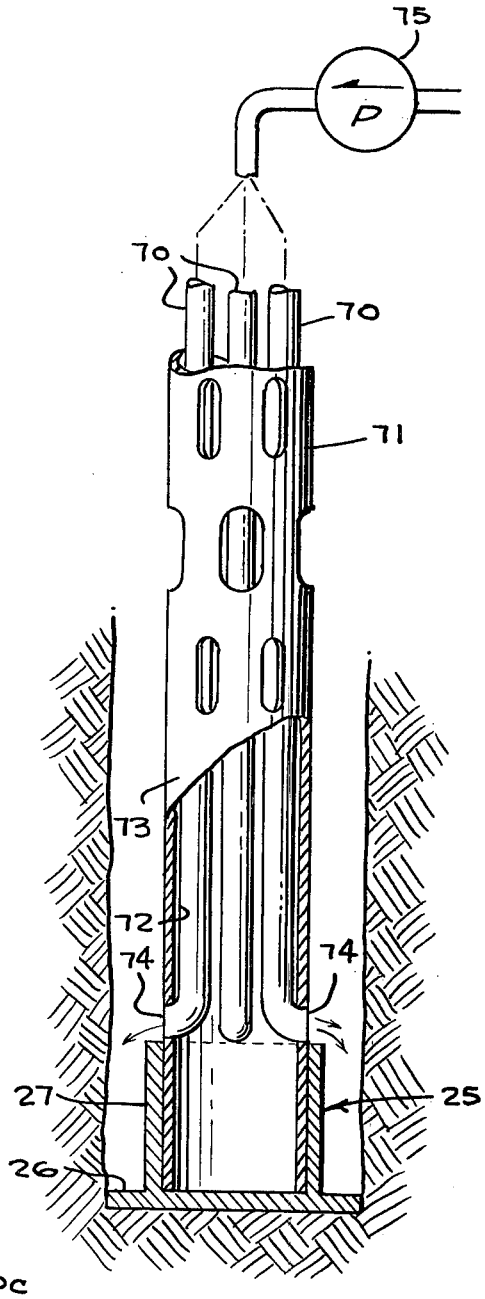
FIG. 8 is a fragmentary section view, similar to FIG. 2, illustrating a further modified caseless concrete pile forming mandrel, driving boot and fill hopper assembly wherein there is incorporated in the mandrel an array of pipes to insure formation of an envelope of flowable concrete in outwardly surrounding relation to the mandrel during driving of the tip.

To insure that a layer of concrete is present along the outside of the mandrel during the pile forming process, the hollow perforated tubular mandrel may be provides with pipes 70, as shown in FIG. 8, running the length of the mandrel 71 through the inner mandrel bore 72, for example, immediately against the inner surface of the mandrel wall 73, having their inlet ends adjacent the top of the mandrel and their lower outlet ends extending outwardly through the mandrel wall at locations immediately above the uppermost portion of the driving tip. For example, if the driving tip is of the boot type, such as the driving tip 25, the lower outlet ends of the pipes 70 would be immediately above the upper end of the sleeve or pipe portion 27 of the driving tip 25. Preferably, the lower ends of the pipes 70 form outwardly directed nozzles or discharge openings 74 so that concrete may be flowed downwardly through the pipes, either under gravity or under pressure, and emerge from the lower outlet openings 74 of the pipes 70 immediately above the driving tip 25 to supply the layer of concrete along the outer surface of the mandrel 71 surrounding the mandrel as the mandrel and driving tip are driven into the soil to form the pile cavity. It will be appreciated that the pipes 70 for supplying the concrete to the region outwardly surrounding the mandrel wall immediately above the driving tip may be either separate pipes of small diameter located in the hollow bore portion of the mandrel, as shown in FIG. 8, or may be formed of pipelike conduits cast in the wall of the mandrel extending substantially the full length of the mandrel having inlet openings adjacent the top of the mandrel and the outlet discharge openings or nozzles adjacent the lower end of the mandrel. Alternatively, the pipes may be formed in any other desired manner to provide relatively small cross-section conduits, compared to the cross-section of the mandrel, through which the concrete may be supplied either under gravity or pumped under pressure to supply the concrete in outwardly surrounding relation to the mandrel wall during the driving of the mandrel and tip into the soil. In the preferred embodiment, the concrete is supplied under pressure by a pump 75, as diagrammatically shown in FIG. 8, to the inlet ends of the pipes 70.

What is claimed is:

1. Apparatus for use with pile driving equipment for forming in the earth a cast-in-place caseless pile of fill material such as concrete or the like introduced in fluid condition into the vertically elongated pile-forming hole in the earth to set upon curing, comprising a. a driving tip member adapted to be driven into the ground having a transversely enlarged portion of the cross section and configuration corresponding to that of the desired pile, b. a vertically elongated driving mandrel for releasably engaging the driving tip member and for transmitting the driving force of the pile driving equipment to the driving tip member, the mandrel being smaller transversely than the diameter of said transversely enlarged portion and having a cross-sectional configuration that affords a large void area for gravity flow of the fill material downwardly throughout the pile-forming hole, and c. movable fill hopper to be disposed in surrounding relation with the mandrel at the upper end of the pile-forming hole forming an upwardly opening receptacle portion having a bottom discharge opening sized to correspond substantially to the maximum cross-sectional area of the driving tip member and receive said mandrel therethrough and having downwardly sloping walls converging to locations closely adjacent the perimeter of said discharge opening for guiding the fill material in said hopper along downwardly converging paths to the discharge opening, d. said fill hopper further including a rigid thin-wall tubular sealing skirt joined to and extending downwardly from said walls adjacent the perimeter of the discharge opening in concentric relation to a vertical center axis through said discharge opening and mandrel and having a configuration corresponding to and slightly smaller than the transversely enlarged portion of the driving tip member to telescopically advance to the depth of the skirt under the weight of the hopper into the upper portion of the pile-forming hole as the hole is formed during initial penetration of the ground by the tip member to substantially form a seal with the walls of the hole against lateral flow of fill material along the ground surface, said fill hopper including a plurality of radial substantially planiform partitions lying in vertical radial planes relative to the axis of the mandrel and discharge opening joined along their radially inner edges to a cylindrical annular wall member joined to said downwardly sloping walls at the perimeter of said discharge opening to define a pluraity of substantially like capacity subdivision compartments of said receptacle portion each adapted to receive a predetermined quantity of flowable fill material therein, and fill material discharge control means provided for each of said compartments movable between closed and open positions for permitting the pile-forming hole being formed by the driving mandrel and tip member.

2. Apparatus for use with pile driving equipment for forming in the earth a cast in place caseless pile of fill material such as concrete or the like introduced in fluid condition into a vertically elongated pile-forming hole in the earth to set upon curing, comprising a. a driving tip member adapted to be driven into the ground having a transversely enlarged portion of cross-section and configuration corresponding to that of the desired pile, b. a vertically elongated driving mandrel for releasably engaging the driving tip member and for transmitting the driving force of the pile driving equipment to the driving tip member, the mandrel being smaller transversely than the diameter of said transversely enlarged portion and having a cross-sectional configuration that affords a large void area for gravity flow of the fill material downwardly throughout the pile-forming hole, and c. a movable fill hopper to be disposed in surrounding relation with the mandrel at the upper end of the pile-forming hole forming an upwardly opening receptacle portion having a bottom discharge opening sized to correspond substantially to the maximum cross-sectional area of the driving tip member and receive said mandrel therethrough and having downwardly sloping walls converging to locations closely adjacent to the perimeter of said discharge opening for guiding the fill material in said hopper along downwardly converging paths to the discharge opening, d. said fill hopper including a plurality of radial substantially planiform partitions lying in vertical radial planes relative to the axis of the mandrel and discharge opening joined along their radially inner edges to a cylindrical annular wall member joined to said downwardly sloping walls at the perimeter of said discharge opening to define a plurality of substantially like capacity subdivision compartments of said receptacle portion each adapted to receive a predetermined quantity of flowable fill material therein, and fill material discharge control means provided for each of said compartments moveable between closed and open positions for permitting discharge of the fill material in the associated compartment into the pile-forming hole being formed by the driving mandrel and tip member.

3. Apparatus as defined in claim 2, wherein said cylindrical annular wall member forms a pipe concentric with a vertical axis intersecting the center of said discharge opening and said pipe extends from said discharge opening to substantially the level of the top of the fill hopper, said pipe having a gate opening therein communicating with each of said compartments for passage of fill material from the respective compartment into the pile-forming hole being formed, and said fill material discharge control means comprising a vertically movable gate member for each compartment slidably supported on said pipe and individually adjustable vertically to selectively close and open the gate opening associated therewith.

* * * * *